US009541040B2

(12) United States Patent
Karunaratne et al.

(10) Patent No.: US 9,541,040 B2
(45) Date of Patent: Jan. 10, 2017

(54) METHOD AND SYSTEMS FOR EXHAUST GAS RECIRCULATION SYSTEM DIAGNOSIS

(71) Applicant: General Electric Company, Schenectady, NY (US)

(72) Inventors: Milan Palinda Karunaratne, Anaheim, CA (US); Benedict George Lander, Harborcreek, PA (US); Chirag Bipinchandra Parikh, Erie, PA (US)

(73) Assignee: General Electric Company, Schenectady, NY (US)

( * ) Notice: Subject to any disclaimer, the term of this patent is extended or adjusted under 35 U.S.C. 154(b) by 182 days.

(21) Appl. No.: 14/478,008

(22) Filed: Sep. 5, 2014

(65) Prior Publication Data

US 2016/0069301 A1 Mar. 10, 2016

(51) Int. Cl.
*F02M 26/49* (2016.01)
*F02M 25/07* (2006.01)

(52) U.S. Cl.
CPC ..... *F02M 26/49* (2016.02); *F02M 25/0702* (2013.01); *F02M 25/072* (2013.01); *F02M 25/0706* (2013.01); *F02M 25/0726* (2013.01); *F02M 25/0749* (2013.01); *F02M 26/43* (2016.02); *F02M 26/47* (2016.02); *F02M 26/10* (2016.02); *F02M 26/22* (2016.02); *F02M 26/38* (2016.02); *F02M 26/44* (2016.02); *F02M 26/50* (2016.02)

(58) Field of Classification Search
CPC ..... F02M 26/49; F02M 26/04; F02M 26/17; F02M 26/22; F02M 26/43
USPC ..... 123/568.11, 568.2–568.32
See application file for complete search history.

(56) References Cited

U.S. PATENT DOCUMENTS 4,273,092 A * 6/1981 Onaka ..... F02M 26/56 123/568.32
5,621,167 A 4/1997 Cheng
6,279,552 B1 * 8/2001 Okada ..... F16K 1/443 123/568.2
6,802,302 B1 * 10/2004 Li ..... F02D 41/0072 123/568.16
7,367,188 B2 * 5/2008 Barbe ..... F02B 37/00 123/568.21
7,380,400 B2 * 6/2008 Barbe ..... F02B 37/12 123/568.11
7,493,762 B2 * 2/2009 Barbe ..... F02D 41/005 123/568.21
8,166,957 B2 * 5/2012 Lupescu ..... F01N 3/0835 123/559.1

(Continued)

OTHER PUBLICATIONS

A European Search Report and Opinion issued in connection with corresponding EP Application No. 15183788.7 on Feb. 4, 2016.

*Primary Examiner* — Joseph Dallo
(74) *Attorney, Agent, or Firm* — John A. Kramer; Global Patent Operation

(57) ABSTRACT

Various methods and systems are provided for diagnosing a condition of a component in an exhaust gas recirculation system. In one example, a method includes selectively routing exhaust from a first subset of engine cylinders to an exhaust passage via a first valve and to an intake passage via a second valve and determining a respective condition of each of the first valve and second valve based on a first exhaust pressure of the first subset of engine cylinders and a second exhaust pressure of a second subset of engine cylinders.

14 Claims, 5 Drawing Sheets

(56) References Cited

U.S. PATENT DOCUMENTS

| | | | | |
|---|---|---|---|---|
| 2001/0029935 | A1* | 10/2001 | Cook | F02M 26/57 123/568.27 |
| 2003/0196646 | A1* | 10/2003 | Shoyama | F02D 13/0246 123/568.14 |
| 2007/0000473 | A1* | 1/2007 | Yamaoka | F02D 41/0072 123/295 |
| 2009/0126706 | A1* | 5/2009 | Shimoda | F01L 9/02 123/568.12 |
| 2009/0199825 | A1 | 8/2009 | Piper et al. | |
| 2009/0301447 | A1* | 12/2009 | Gates | F02M 26/57 123/568.29 |
| 2010/0263627 | A1* | 10/2010 | Whitney | F02D 11/10 123/399 |
| 2012/0096927 | A1 | 4/2012 | Freund | |
| 2012/0145134 | A1* | 6/2012 | Miyazaki | F02D 9/1065 123/568.2 |
| 2012/0197550 | A1 | 8/2012 | Cianflone | |
| 2013/0042843 | A1* | 2/2013 | Sano | F02D 21/08 123/568.16 |
| 2013/0139794 | A1* | 6/2013 | Hiroe | F02D 41/0077 123/568.11 |
| 2013/0186376 | A1* | 7/2013 | Peters | F02D 41/0065 123/568.2 |
| 2014/0214302 | A1 | 7/2014 | Parikh | |

* cited by examiner

METHOD AND SYSTEMS FOR EXHAUST GAS RECIRCULATION SYSTEM DIAGNOSIS

BACKGROUND

Technical Field

Embodiments of the subject matter disclosed herein relate to engines. Other embodiments relate to engine diagnostics.

Discussion of Art

Engines may utilize recirculation of exhaust gas from an engine exhaust system to an engine intake system, a process referred to as exhaust gas recirculation (EGR), to reduce regulated emissions. In some examples, a group of one or more cylinders may have an exhaust manifold that is exclusively (and/or selectively) coupled to an intake passage of the engine such that the group of cylinders is dedicated, at least under some conditions, to generating exhaust for EGR. Such cylinders may be referred to as "donor cylinders." Further, some EGR systems may include multiple valves to direct exhaust to an intake passage and/or an exhaust passage based on a desired amount of EGR. Under some conditions, the multiple valves may become stuck in undesired positions, or may be inadvertently mispositioned. Further still, degradation of one or more of these multiple valves, or other EGR system components, may result in degradation in engine performance and/or eventual engine shutdown.

BRIEF DESCRIPTION

In one embodiment, a method (e.g., a method for controlling an engine system) comprises selectively routing exhaust from a first subset of engine cylinders to an exhaust passage via a first valve and to an intake passage via a second valve. The method further comprises determining a respective condition of each of the first valve and second valve based on a first exhaust pressure of the first subset of engine cylinders and a second exhaust pressure of a second subset of engine cylinders.

DETAILED DESCRIPTION

The following description relates to embodiments of methods and systems for diagnosing a condition of one or more components in an exhaust gas recirculation (EGR) system. In one example, a method includes selectively routing exhaust from a first subset of engine cylinders to an exhaust passage via a first valve and to an intake passage via a second valve. The method further includes determining a condition of each of the first valve and second valve based on a first exhaust pressure of the first subset of engine cylinders and a second exhaust pressure of a second subset of engine cylinders. In such an example, the condition of the first valve and/or the second valve may be degradation of the first and/or second valve (e.g., one or both of the valves are stuck closed due to mispositioning, mechanical failure, or actuator failure). As a result, engine servicing and/or valve checking routines may be targeted based on the condition of the two valves.

Figure 1:
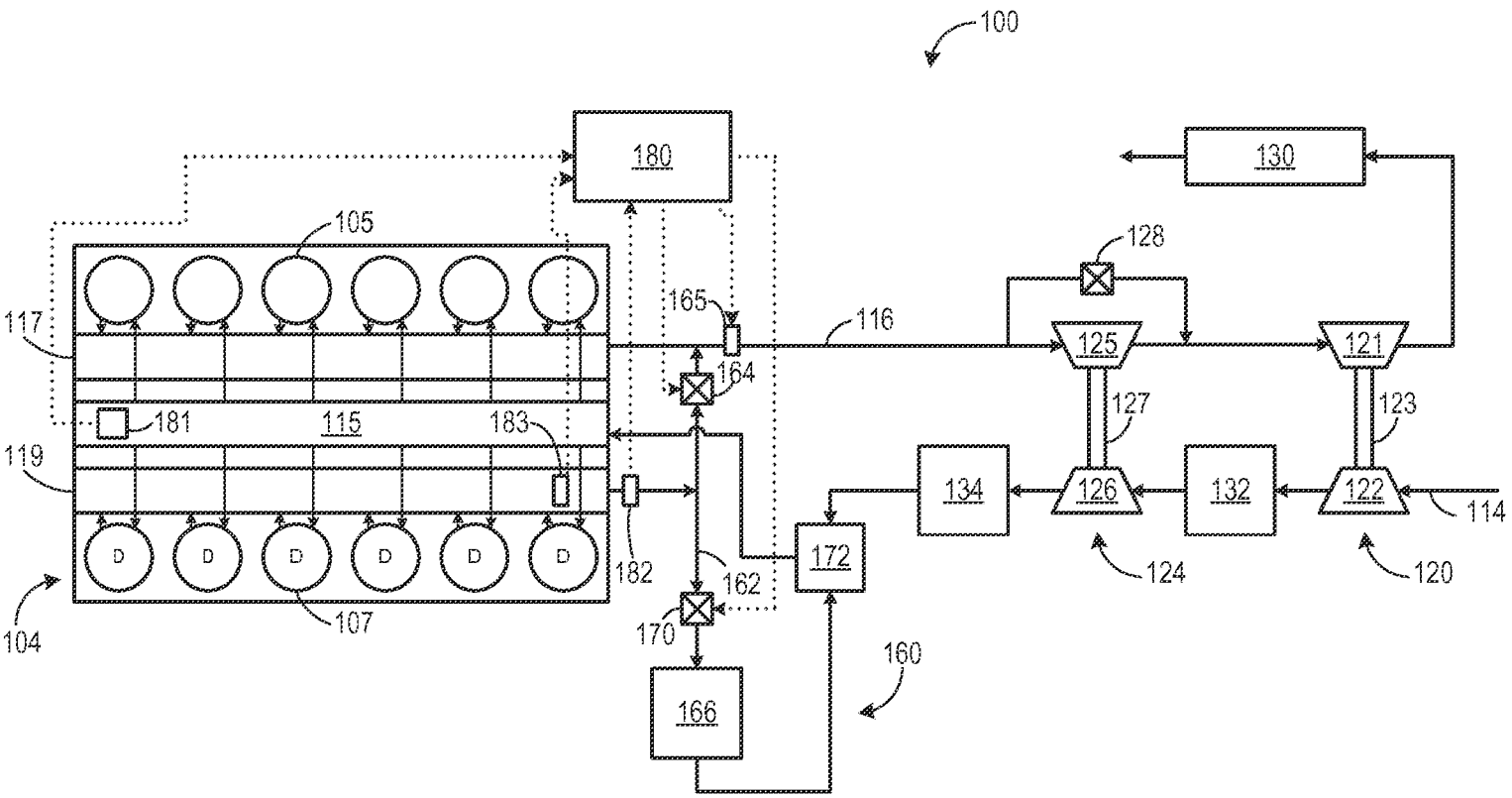
FIG. 1 shows a schematic diagram of an engine with an exhaust gas recirculation system according to an embodiment of the invention.
Figure 4:
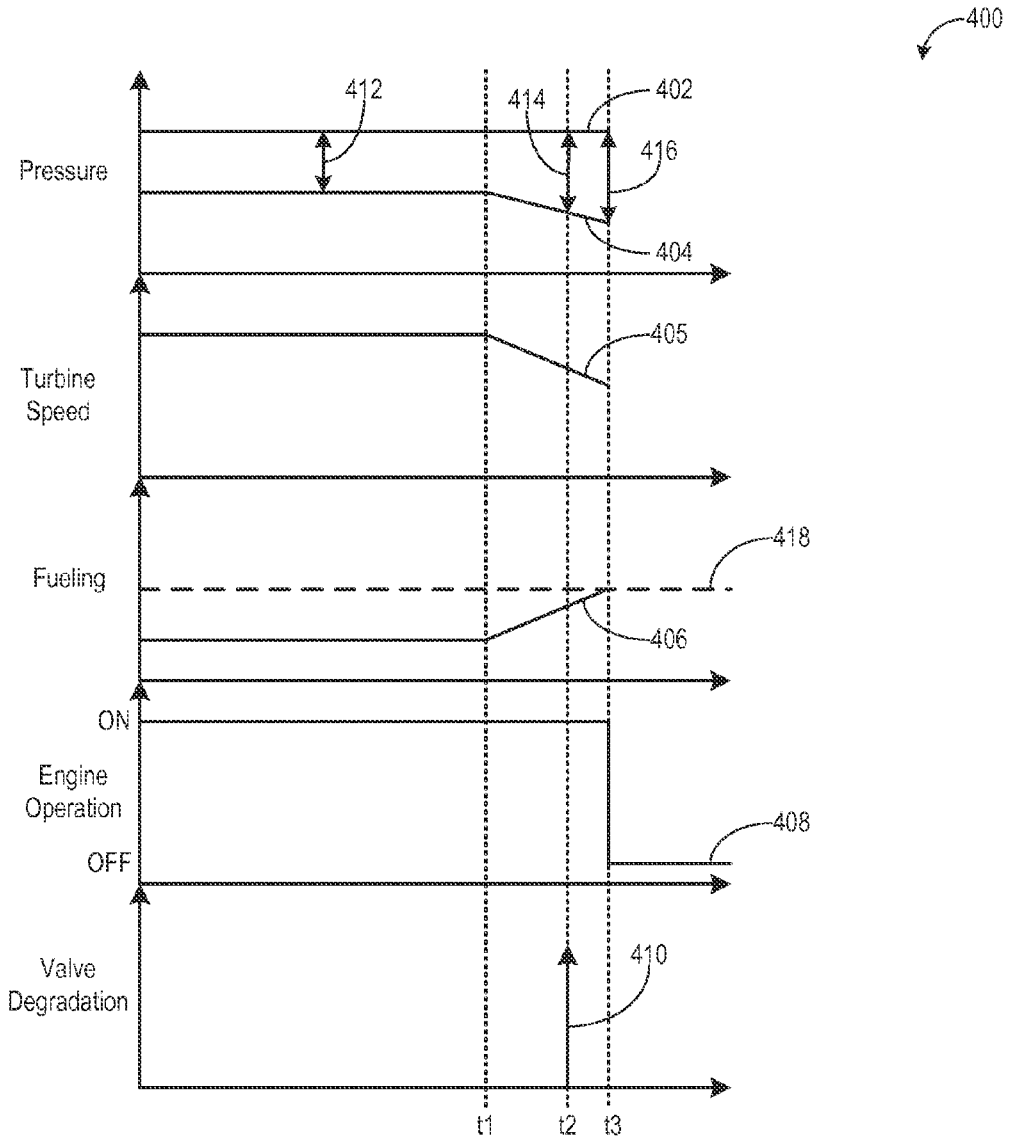
FIGS. 4-5 show graphs illustrating changes in exhaust pressures due to degradation of one or more exhaust gas recirculation system components according to an embodiment of the invention.
Figure 5:
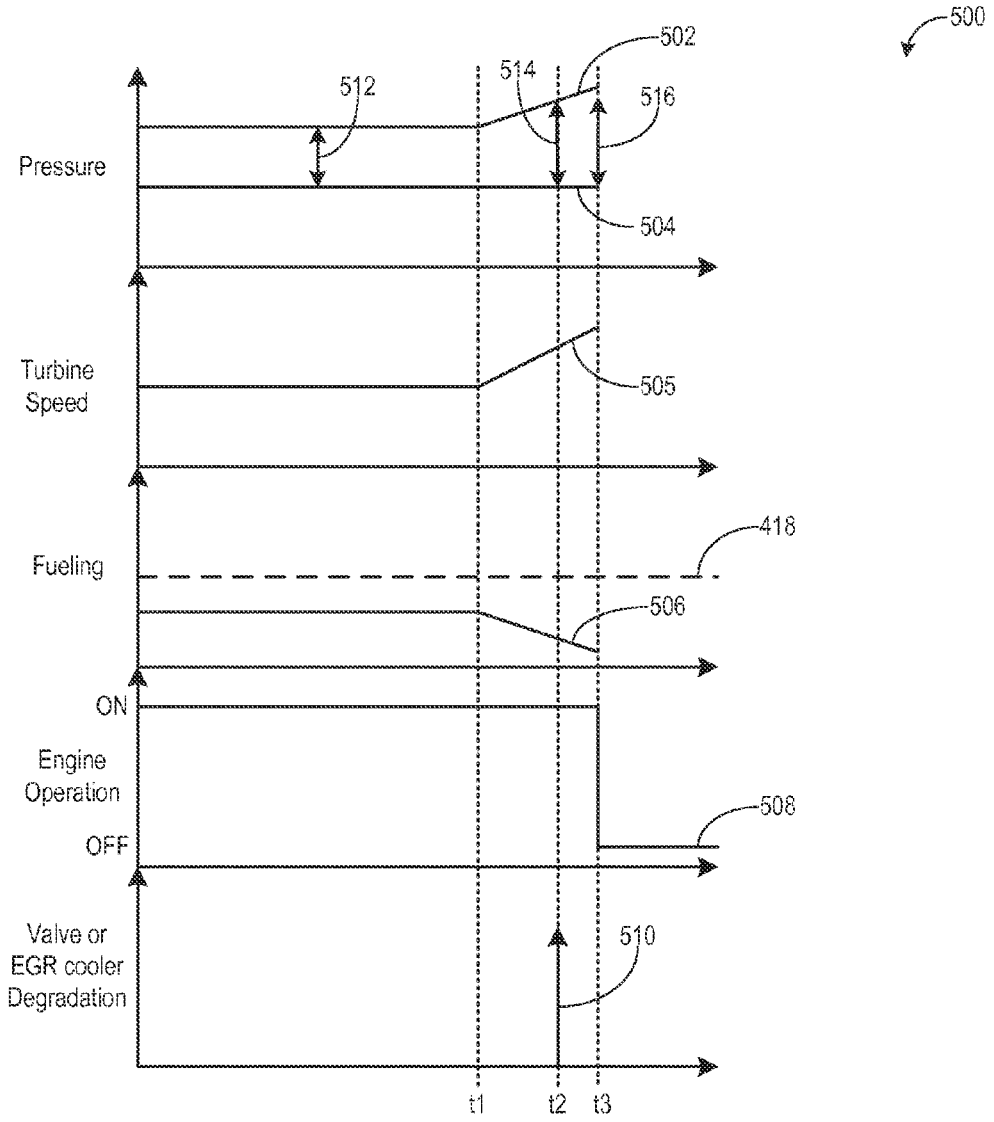

FIG. 1 shows an embodiment of an engine including an EGR system including a first valve, second valve, and EGR cooler. The first valve controls a flow of exhaust from a donor cylinder exhaust manifold to an exhaust passage while the second valve controls a flow of exhaust from the donor cylinder exhaust manifold to the EGR cooler and intake passage. An engine controller may adjust a position of the first and second valve based on engine operating conditions, as shown in a method presented at FIG. 2. During operation, one or more of the first and second valves may become degraded or stuck in a closed position. In another example, the EGR cooler may become degraded or restricted. As a result, engine performance may become degraded due to changing exhaust pressures. As shown at FIG. 3, the engine controller may detect EGR component degradation based on a pressure difference between exhaust of the donor cylinders and exhaust of non-donor cylinders. Additionally, which component is degraded (e.g., which of the first or second valve) may be determined based on which exhaust pressure is driving an increase in the pressure difference. FIGS. 4-5 illustrate the changing exhaust pressures under different component degradation conditions and the resulting control actions taken by the engine controller.

The approach described herein may be employed in a variety of engine types, and a variety of engine-driven systems. Some of these systems may be stationary, while others may be on semi-mobile or mobile platforms. Semi-mobile platforms may be relocated between operational periods, such as mounted on flatbed trailers. Mobile platforms include self-propelled vehicles. Such vehicles can include on-road transportation vehicles, as well as mining equipment, marine vessels, rail vehicles, and other off-highway vehicles (OHV). For clarity of illustration, a locomotive is provided as an example of a mobile platform supporting a system incorporating an embodiment of the invention.

Before further discussion of the approach for indicating EGR component (e.g., valve) degradation based on a different in donor and non-donor exhaust manifold pressures, FIG. 1 presents a block diagram of an exemplary embodiment of an engine system 100 with an engine 104, such as an internal combustion engine.

The engine receives intake air for combustion from an intake, such as an intake manifold 115. The intake may be any suitable conduit or conduits through which gases flow to enter the engine. For example, the intake may include the intake manifold, an intake passage 114, and the like. The intake passage receives ambient air from an air filter (not shown) that filters air from outside of a vehicle in which the engine may be positioned. Exhaust gas resulting from combustion in the engine is supplied to an exhaust, such as exhaust passage 116. The exhaust may be any suitable conduit through which gases flow from the engine. For example, the exhaust may include an exhaust manifold, the exhaust passage, and the like. Exhaust gas flows through the exhaust passage. In one embodiment, the exhaust passage includes a NOx and/or oxygen sensor for measuring a NOx and oxygen level of the exhaust gas.

In the example embodiment depicted in FIG. 1, the engine is a V-12 engine having twelve cylinders. In other examples, the engine may be a V-6, V-8, V-10, V-16, I-4, I-6, I-8, opposed 4, or another engine type. As depicted, the engine includes a subset of non-donor cylinders 105, which includes six cylinders that supply exhaust gas exclusively to a non-donor cylinder exhaust manifold 117, and a subset of donor cylinders 107, which includes six cylinders that supply exhaust gas exclusively to a donor cylinder exhaust manifold 119. In other embodiments, the engine may include at least one donor cylinder and at least one non-donor cylinder. For example, the engine may have four donor cylinders and eight non-donor cylinders, or three donor cylinders and nine non-donor cylinders. It should be understood, the engine may have any desired numbers of donor cylinders and non-donor cylinders, with the number of donor cylinders typically lower than the number of non-donor cylinders.

As depicted in FIG. 1, the non-donor cylinders are coupled to the exhaust passage to route exhaust gas from the engine to atmosphere (after it passes through an exhaust gas treatment system 130 and first and second turbochargers 120 and 124). The donor cylinders, which provide engine exhaust gas recirculation (EGR), are coupled exclusively to an EGR passage 162 of an EGR system 160 which routes exhaust gas from the donor cylinders to the intake passage of the engine, and not to atmosphere. By introducing cooled exhaust gas to the engine, the amount of available oxygen for combustion is decreased, thereby reducing combustion flame temperatures and reducing the formation of nitrogen oxides (e.g., $NO_x$).

In the example embodiment shown in FIG. 1, when a second valve 170 is open, exhaust gas flowing from the donor cylinders to the intake passage passes through a heat exchanger such as an EGR cooler 166 to reduce a temperature of (e.g., cool) the exhaust gas before the exhaust gas returns to the intake passage. The EGR cooler may be an air-to-liquid heat exchanger, for example. In such an example, one or more charge air coolers 132 and 134 disposed in the intake passage (e.g., upstream of where the recirculated exhaust gas enters) may be adjusted to further increase cooling of the charge air such that a mixture temperature of charge air and exhaust gas is maintained at a desired temperature. In other examples, the EGR system may include an EGR cooler bypass. Alternatively, the EGR system may include an EGR cooler control element. The EGR cooler control element may be actuated such that the flow of exhaust gas through the EGR cooler is reduced; however, in such a configuration, exhaust gas that does not flow through the EGR cooler is directed to the exhaust passage rather than the intake passage.

Further, the EGR system includes a first valve 164 disposed between the exhaust passage and the EGR passage. The second valve may be an on/off valve controlled by the control unit 180 (for turning the flow of EGR on or off), or it may control a variable amount of EGR, for example. In some examples, the first valve may be actuated such that an EGR amount is reduced (exhaust gas flows from the EGR passage to the exhaust passage). In other examples, the first valve may be actuated such that the EGR amount is increased (e.g., exhaust gas flows from the exhaust passage to the EGR passage). In some embodiments, the EGR system may include a plurality of EGR valves or other flow control elements to control the amount of EGR.

In such a configuration, the first valve is operable to route exhaust from the donor cylinders to the exhaust passage of the engine and the second valve is operable to route exhaust from the donor cylinders to the intake passage of the engine. In the example embodiment shown in FIG. 1, the first valve and the second valve may be engine oil, or hydraulically, actuated valves, for example, with a shuttle valve (not shown) to modulate the engine oil. In some examples, the valves may be actuated such that one of the first and second valves and is normally open and the other is normally closed. In other examples, the first and second valves and may be pneumatic valves, electric valves, or another suitable valve.

The engine system further includes a donor cylinder exhaust pressure sensor 183 disposed in the donor cylinder exhaust manifold upstream of the first valve and the second valve. In an alternate embodiment, the donor cylinder exhaust pressure sensor may be positioned in the exhaust gas recirculation system upstream of the first valve and the second valve. A temperature sensor 182 is disposed in the exhaust gas recirculation system upstream of the first valve and the second valve. As described below with reference to FIGS. 2 and 3, the first and second valves and may be adjusted based on temperature measured by the temperature sensor and/or pressure measured by the donor cylinder exhaust pressure sensor. In some embodiments, each of the engine cylinders may include a separate temperature sensor and/or pressure sensor such that there are a plurality of temperature sensors and/or pressure sensors. In other examples, the engine system may include a plurality of temperatures sensors disposed downstream of the exhaust valve of each of the engine cylinders and only one pressure sensor, or vice versa. Further, degradation of the first valve and the second valve may be at least partially based on the donor cylinder exhaust pressure (e.g., donor cylinder exhaust manifold pressure) measured by the donor cylinder exhaust pressure sensor.

As shown in FIG. 1, the engine system further includes an EGR mixer 172 which mixes the recirculated exhaust gas with charge air such that the exhaust gas may be evenly distributed within the charge air and exhaust gas mixture. In the example embodiment depicted in FIG. 1, the EGR system is a high-pressure EGR system which routes exhaust gas from a location upstream of the turbochargers in the exhaust passage to a location downstream of the turbochargers in the intake passage. In other embodiments, the engine system may additionally or alternatively include a low-pressure EGR system which routes exhaust gas from downstream of the turbochargers in the exhaust passage to a location upstream of the turbochargers in the intake passage.

As depicted in FIG. 1, the engine system further includes a two-stage turbocharger with the first turbocharger 120 and the second turbocharger 124 arranged in series, each of the turbochargers arranged between the intake passage and the exhaust passage. The two-stage turbocharger increases air charge of ambient air drawn into the intake passage in order to provide greater charge density during combustion to increase power output and/or engine-operating efficiency. The first turbocharger operates at a relatively lower pressure, and includes a first turbine 121 which drives a first compressor 122. The first turbine and the first compressor are mechanically coupled via a first shaft 123. The second turbocharger operates at a relatively higher pressure, and includes a second turbine 125 which drives a second compressor 126. The second turbine and the second compressor are mechanically coupled via a second shaft 127. In the example embodiment shown in FIG. 1, the second turbocharger is provided with a wastegate 128 which allows exhaust gas to bypass the second turbocharger. The wastegate may be opened, for example, to divert the exhaust gas flow away from the second turbine. In this manner, the rotating speed of the compressors, and thus the boost provided by the turbochargers to the engine may be regulated during steady state conditions. In other embodiments, each of the turbochargers may be provided with a wastegate, or only the second turbocharger may be provided with a wastegate.

As explained above, the terms "high pressure" and "low pressure" are relative, meaning that "high" pressure is a pressure higher than a "low" pressure. Conversely, a "low" pressure is a pressure lower than a "high" pressure.

The engine system further includes an exhaust treatment system 130 coupled in the exhaust passage in order to reduce regulated emissions. As depicted in FIG. 1, the exhaust gas treatment system is disposed downstream of the first turbine of the first (low pressure) turbocharger. In other embodiments, an exhaust gas treatment system may be additionally or alternatively disposed upstream of the first turbocharger. The exhaust gas treatment system may include one or more components. For example, the exhaust gas treatment system may include one or more of a diesel particulate filter (DPF), a diesel oxidation catalyst (DOC), a selective catalytic reduction (SCR) catalyst, a three-way catalyst, a $NO_x$ trap, and/or various other emission control devices or combinations thereof. In an alternate embodiment, the engine system may not include an exhaust treatment system with a DPF, DOC, or SCR.

The engine system further includes the control unit 180, which is provided and configured to control various components related to the engine system. The control unit may also be referred to herein as the engine controller, or controller. In one example, the control unit includes a computer control system. The control unit further includes non-transitory, computer readable storage media (not shown) including code for enabling on-board monitoring and control of engine operation. The control unit, while overseeing control and management of the engine system, may be configured to receive signals from a variety of engine sensors, as further elaborated herein, in order to determine operating parameters and operating conditions, and correspondingly adjust various engine actuators to control operation of the engine system. For example, the control unit may receive signals from various engine sensors including, but not limited to, engine speed, engine load, boost pressure, ambient pressure, exhaust temperature, exhaust pressure, etc. Correspondingly, the control unit may control the engine system by sending commands to various components such as traction motors, alternator, cylinder valves, throttle, heat exchangers, wastegates or other valves or flow control elements, etc.

As another example, the control unit may receive signals from various temperature sensors and pressure sensors disposed in various locations throughout the engine system. For example, the control unit may receive signals from the temperature sensor 182 positioned upstream of the EGR cooler, the donor cylinder exhaust pressure sensor positioned upstream of the first and second valves in the EGR system, a non-donor cylinder exhaust pressure sensor 185 positioned in the exhaust passage upstream of the turbochargers, and a manifold air temperature (MAT) sensor 181 positioned in the intake manifold. As shown in FIG. 1, the non-donor cylinder exhaust pressure sensor is positioned downstream from an inlet of exhaust from the EGR passage (e.g., downstream from the first valve). In an alternate embodiment, the non-donor cylinder exhaust pressure sensor may be positioned in the non-donor cylinder exhaust manifold and/or upstream of the inlet of exhaust from the EGR passage.

Based on the signals received indicating the EGR temperatures and pressures and the manifold air temperature, for example, one or both of the first valve and the second valve may be adjusted to adjust an amount of exhaust gas flowing through the EGR cooler to control the manifold air temperature or to route a desired amount of exhaust to the intake manifold for EGR.

Figure 2:
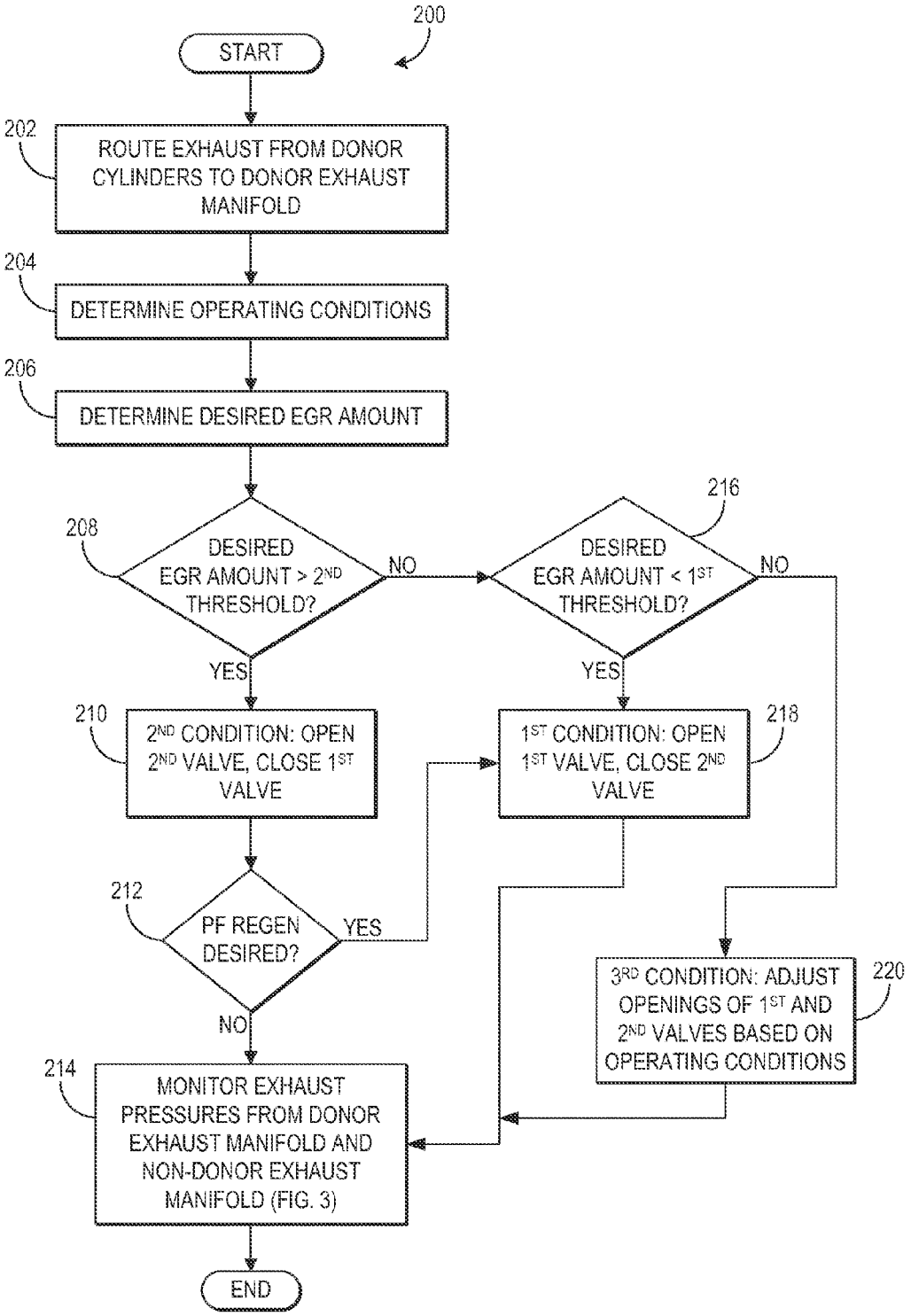
FIG. 2 shows a flow chart illustrating a method for adjusting first and second valves in an exhaust gas recirculation system according to an embodiment of the invention.
Figure 3:
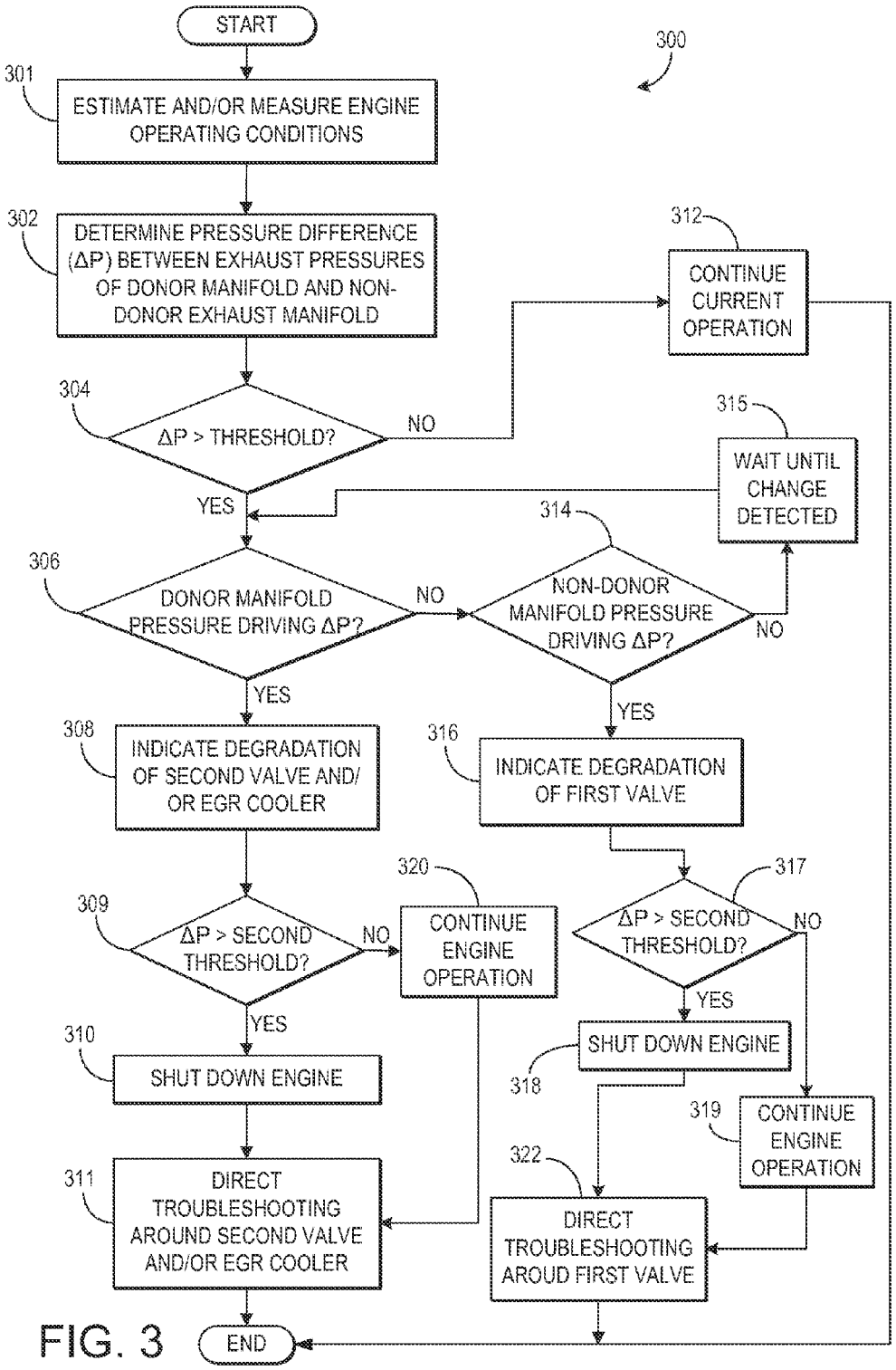
FIG. 3 shows a flow chart illustrating a method for determining a condition of an exhaust gas recirculation system component according to an embodiment of the invention.

FIGS. 2 and 3 show flow charts illustrating methods for an exhaust gas recirculation system with first and second valves, such as the exhaust gas recirculation system 160 described above with reference to FIG. 1. In particular, FIG. 2 shows a method for controlling the first and second valves in the EGR system based on operating conditions. For example, when more EGR is desired, the second valve may be adjusted to be more open and the first valve may be adjusted to be more closed. Likewise, when less EGR is desired, the first valve may be adjusted to be more open and the second valve may be adjusted to be more closed. In this way, an engine controller (e.g., control system 180 shown in FIG. 1) may control the first valve and the second valve together to adjust EGR flow. As will be described below, the system may operate under three conditions based on the positions of the first and second valve. Further, during each of the three conditions, pressure may be monitored in the donor cylinder exhaust manifold and the non-donor cylinder exhaust manifold (or directly downstream of the exhaust manifolds) such that an engine component condition, such as degradation of the valves, may be determined, as described with reference to FIG. 3. Instructions for carrying out the methods of FIG. 2 and FIG. 3 may be stored in a memory of the controller.

Continuing to FIG. 2, a flow chart illustrating a method 200 for controlling first and second valves in an exhaust gas recirculation system, such as the first and second valve described above with reference to FIG. 1, is shown. Specifically, the method determines current operating conditions and adjusts the valves based on the operating conditions. For example, the valves may be adjusted based on a desired amount of EGR or to facilitate particulate filter regeneration if the engine includes a particulate filter.

At step 202 of the method, exhaust from the donor cylinders is routed to the donor cylinder exhaust manifold. For example, after combustion occurs in each of the donor cylinders, an exhaust valve of each of each of the cylinders opens such that exhaust may be released from the cylinders into the donor cylinder exhaust manifold.

At step 204, operating conditions are determined. As non-limiting examples, the operating conditions may include engine load, engine speed, exhaust temperature, amount of $NO_x$ generation, and the like. Once the operating conditions are determined, a desired amount of EGR is determined at step 206. The desired amount of EGR may be based on conditions such as the amount of $NO_x$ generation. For example, as the amount of $NO_x$ generated during combustion increases or as a target air fuel ratio increases, a greater amount of EGR may be desired, and vice versa. In one embodiment, NOx may be measured by a NOx sensor in the exhaust passage of the engine.

Once the desired amount of EGR is determined, the method proceeds to step 208 where it is determined if the desired amount of EGR is greater than a second threshold. As an example, the second threshold may be close to or approximately a maximum amount of EGR based on the operating conditions. For example, the second threshold may be an amount of EGR that is achievable under the current operating conditions when the first valve is fully closed and the second valve is fully open.

If it is determined that the desired amount of EGR is greater than the second threshold amount, the controller adjusts the first and second valves at 210 such that a second condition is carried out. During the second condition, the second valve is opened substantially more than the first valve, and the first valve is closed more than a threshold amount. In one example, the second valve is opened and the first valve is closed such that substantially all the exhaust from the donor cylinders flows to the intake manifold for exhaust gas recirculation. In this manner, the amount of EGR may be increased to the desired amount.

At step 212, the method includes determining if particulate filter regeneration is desired. Particulate filter regeneration may be desired when a soot level of the particulate filter exceeds a threshold level, for example. The particulate filter may be included as part of an exhaust gas treatment system (such as exhaust gas treatment system 130 shown in FIG. 1). As one example, it may be determined that the soot level is greater than the threshold level based on a pressure drop across the particulate filter or a soot sensor disposed in the particulate filter. In alternate embodiments, the engine system may not include a particulate filter. In this embodiment, the method may proceed directly from 210 to 214.

If it is determined that particulate filter regeneration is not desired (or if no particulate filter is included in the engine system), the method continues to step 214 and pressures in the donor cylinder and non-donor cylinder exhaust manifolds are monitored, as will be described in greater detail with reference to FIG. 3. The pressure in the non-donor cylinder exhaust manifold may also be measured downstream of the non-donor cylinder exhaust manifold in the exhaust passage, as shown in FIG. 1. Said another way, the engine controller may monitor the pressure of exhaust from both the non-donor cylinder exhaust manifold and the donor cylinder exhaust manifold. For example, the exhaust pressures are estimated such that EGR system component degradation may be determined.

Returning to step 208, if it is determined that the desired amount of EGR is less than the second threshold, the method moves to step 216 and it is determined if the desired amount of EGR is less than a first threshold. The first threshold may be a minimum amount of EGR, for example, or substantially no EGR. The desired amount of EGR may be less than the first threshold amount during conditions such as low engine load and/or when $NO_x$ generation is less than a threshold level, for example.

If it is determined that the desired amount of EGR is less than the threshold amount at step 216 or if it is determined that particulate filter regeneration is desired at step 212, the method moves to step 218, and the controller adjusts the first and second valves such that a first condition is carried out. During the first condition, the first valve may be opened substantially more than the second valve, and the second valve is closed more than a threshold amount. In one example, the first valve may be fully opened and the second valve may be fully closed such that substantially all the exhaust flows from the donor cylinders to the exhaust manifold. In this manner, the amount of EGR may be substantially reduced, for example. Further, particulate filter regeneration may be carried out under high load conditions, and a temperature of the exhaust may be further increased to facilitate particulate filter regeneration by closing the second valve and opening the first valve such that substantially all the exhaust is routed to the exhaust passage.

In some examples, particulate filter regeneration may be carried out by closing the first and second valves and cutting-off fuel injection to the donor cylinders. In such a configuration, the donor cylinders may work against the valves as only a compressor, thereby increasing the load to the non-donors cylinders. The increased load on the non-donor cylinders allows for higher exhaust gas temperatures in the aftertreatment system, for example, allowing for regeneration of the particulate filter or temperatures that are conducive for active regeneration.

Continuing with FIG. 2, once the first valve is opened and the second valve is closed, the method continues to step 214 where exhaust pressures in the donor cylinder exhaust manifold and non-donor cylinder exhaust manifold (or the exhaust pressure directly downstream of the non-donor cylinder exhaust manifold in the exhaust passage) are monitored, as will be described below with reference to FIG. 3.

Returning to step 216, if it is determined that the EGR amount is greater than the first threshold amount (but less than the second threshold amount), the method moves to step 220, and the controller adjust the first and second valves based on operating conditions such that a third condition is carried out. During the third condition, the first valve and the second valve may be concurrently at least partially opened or opened greater than a threshold amount. In one example, the first valve and the second valve may be opened the same amount. In another example, the first valve may be opened more than the second valve. As yet another example, the second valve may be opened more than the first valve. By concurrently opening the first and second valves at least partially, the amount of EGR may be reduced from the maximum amount of EGR (e.g., when the first valve is fully closed and the second valve is fully open), and relatively different amounts of exhaust may be routed to the intake passage and the exhaust passage.

Once each of the first and second valves is opened greater than a threshold amount, the method continues to step 214 where exhaust pressures from the donor exhaust manifold and the non-donor exhaust manifold are monitored, as will be described below with reference to FIG. 3.

Thus, the exhaust gas recirculation system may be operated under several conditions. Under the first condition, the second valve is closed more than a threshold amount and substantially all of the exhaust from the donor cylinders is routed to the exhaust passage. Under the second condition, the first valve is closed more than a threshold amount and substantially all of the exhaust from the donor cylinder is routed to the intake passage. Under the third condition, the first valve and the second valve are each open more than a threshold amount and different portions of exhaust may be routed from the donor cylinders to the intake passage and the exhaust passage. Under each of the conditions, exhaust pressure from the donor cylinder exhaust manifold and the non-donor exhaust manifold may be monitored such that degradation of a component in the EGR system may be identified, as described below.

Continuing to FIG. 3, a flow chart illustrating a method for determining a condition of an exhaust gas recirculation (EGR) system component, such as the components of the EGR system described above with reference to FIG. 1, is shown. The conditions of the EGR system component may include one or more of a degraded EGR valve, a stuck EGR valve, a mispositioned EGR valve (e.g., closed when it is commanded to be open), a fouled EGR cooler, or the like. The condition of the EGR system may be based on an exhaust pressure of a set of donor cylinders and an exhaust pressure of a set of non-donor cylinders. Each of the set of donor cylinders and the non-donor cylinders may be coupled to a corresponding donor exhaust manifold or non-donor exhaust manifold. The exhaust pressures used in method 300 may be estimated and/or measured based on an output of a first pressure sensor positioned in or downstream of the donor exhaust manifold (e.g., such as pressure sensor 183 shown in FIG. 1) and an output of a second pressure sensor positioned in or downstream of the non-donor exhaust manifold (e.g., such as pressure sensor 185 shown in FIG. 1). Additionally, which one of two EGR valves is degraded may be based on the two exhaust pressures. As used herein, valve degradation may include a mispositioned valve, a stuck valve, and/or a valve with degraded function. In another example, method 300 may be used to diagnose a position of each EGR valve. As shown in FIG. 1, a first EGR valve controls exhaust flow from the donor cylinders and to the exhaust passage while the second EGR valve controls exhaust flow from the donor cylinders and to the intake passage.

Method 300 begins at 301 by estimating and/or measuring engine operating conditions. Engine operating conditions may include engine speed and load, notch level, exhaust temperature, exhaust NOx level, exhaust oxygen level, exhaust pressure of a donor cylinder exhaust manifold, exhaust pressure of a non-donor cylinder exhaust manifold, turbine speed, engine fueling, or the like. At 302, the method includes determining a pressure difference between exhaust pressures of the donor exhaust manifold and the non-donor exhaust manifold. As described above, the donor manifold exhaust pressure may be measured in the donor exhaust manifold or downstream of the donor exhaust manifold and upstream of the first and second EGR valves. The non-donor manifold pressure may be measured in the non-donor exhaust manifold or downstream of the non-donor exhaust manifold and upstream of a turbocharger (e.g., upstream of all turbine stages of all turbochargers). In some examples, the exhaust pressure sensors may provide a continuous indication of donor cylinder and non-donor cylinder exhaust pressure. In other examples, the exhaust pressure sensors may provide pressure measurements at predetermined intervals (e.g., 2 seconds, 5 seconds, 30 seconds, or the like).

Once the exhaust pressure difference is determined at 302, the method continues to 304 where it is determined if the pressure difference is greater than a threshold pressure difference. The threshold pressure difference may be a first threshold pressure difference based on a pressure difference between the donor and non-donor exhaust pressures during non-degraded EGR system operation. For example, when both EGR valves are functioning and in commanded positions, the pressure difference may be below the first threshold difference. In one example, the first threshold pressure difference may be based on current operating conditions and the current operating condition of the two EGR valves (as described above with reference to FIG. 2). As such, the expected difference between the donor and non-donor manifold exhaust pressures may be different at different valve operating conditions (e.g., when the valves are in different positions). In another example, the first threshold difference may be an average value based on an average pressure difference between the donor and non-donor exhaust pressures over a range of valve operating conditions (e.g., overall all the different valve operating conditions or position combinations). If the pressure difference between the exhaust pressures of donor and non-donor cylinders is not greater than the first threshold difference, the method continues current engine operation at 312. For example, the method at 312 may include not indicating degradation of either of the first and second EGR valves. In another example, the method at 312 may include indicating proper functioning of both the first and second EGR valves and/or the EGR cooler. In one example, not indicating degradation of either of the first and second EGR valves or indicating proper functioning of both the first and second EGR valves and/or the EGR cooler may include sending a signal to a control display visible to a user, the control display including a visual indicator controlled by the signal received from the controller of whether the two EGR valves and/or the EGR cooler are functioning properly (e.g., healthy). In another example, the method at 312 may include not shutting down the engine and not running valve diagnostic routines responsive to the indication that the EGR valves and EGR cooler are not degraded and functioning properly.

Alternatively, if the pressure difference between the donor and non-donor exhaust pressures is greater than the first threshold, the method continues on to 306 to determine if the donor manifold exhaust pressure is driving the increase in the pressure difference. In other words, the method at 306 may include determining if the exhaust pressure from the donor manifold is changing more than the exhaust pressure from the non-donor exhaust manifold. For example, the method at 306 may determine if the donor manifold exhaust pressure is increasing while the non-donor manifold exhaust pressure is within a threshold of an average (or previous) value. In one example, the method at 306 may include determining if the donor manifold pressure is increasing (e.g., from a base, average, or previous level) by a threshold amount while the pressure difference between the two exhaust pressures is greater than the first threshold difference. In this way, the difference between the donor and non-donor exhaust pressures may be increasing due to the donor exhaust manifold pressure increasing. In another example, one exhaust pressure changing more than another (e.g., the donor manifold exhaust pressure changing more than the non-donor exhaust manifold pressure) may be determined based on a rate of change in the two pressures relative to one another. For example, if the rate of change of the donor manifold exhaust manifold pressure over a set duration is greater than the rate of change of the non-donor exhaust manifold pressure, the donor manifold exhaust pressure may be changing more and thus driving the increase in the pressure difference.

If the donor manifold exhaust pressure is driving the increasing the exhaust pressure difference between the donor and non-donor cylinder manifolds, the method continues on to 308 to indicate degradation of the second EGR valve controlling exhaust flow to the intake passage and/or degradation of the EGR cooler. For example, if the second EGR valve is stuck closed (e.g., either due to degradation or mispositioning) and/or the EGR cooler is fouled (e.g., the flow resistance of the EGR cooler has increased substantially), pressure may build up in the donor exhaust manifold when the first EGR valve is also closed and/or partially closed (e.g., during the second condition shown in FIG. 2). The exhaust pressure from the non-donor exhaust manifold may remain the same and/or only change slightly in comparison to the increase in the donor manifold exhaust pressure. Thus, the pressure difference between these two exhaust pressures increases due to a restriction between the donor cylinders and the intake passage (e.g., via a closed second EGR valve and/or fouled EGR cooler).

In one example, indicating degradation of the second EGR valve and/or EGR cooler (or of the first EGR valve at step 316, discussed further below) may include sending a signal to another system, adjusting engine operation, and/or setting a diagnostic code. For example, indicating degradation of one or more of the EGR valves or EGR cooler may include setting a diagnostic code within the controller to run targeted valve trouble-shooting routines when the engine is able (e.g., during engine idle or engine off conditions). In another example, indicating degradation of one or more of the EGR valves or EGR cooler may include alerting a vehicle operator that one or more indicated components is degraded. Specifically, the controller may send a signal to a visual control display (visible to the vehicle operator) indicating which component(s) have been identified as degraded (or mispositioned). In yet another example, indicating degradation as explained above may include controlling the engine in response to the indication, where controlling the engine may include actuating the indicated valve, shutting down the engine, adjusting a position of one or more of the EGR valves, or the like.

If the first EGR valve is at least partially open (e.g., not fully closed) at 308 while the increase in pressure difference is due to the increase in donor manifold exhaust pressure, then turbine speed may increase due to an increase in exhaust flow being directed through the exhaust passage and one or more turbochargers. In one example, the turbine speed may be a speed of a high pressure turbine upstream of a low pressure turbine. In another example, the turbine speed may be a speed of an only turbine in the engine system. The method at 308 may further include, in response to the increase in turbine speed due to the improperly closed second EGR valve and/or fouled EGR cooler, decreasing fuel delivered to the engine cylinders to maintain a desired turbine speed and intake manifold pressure. In one example, the engine cylinders may include only the non-donor cylinders. In another example, the engine cylinders may include both the non-donor and donor cylinders. In yet another example, the controller may adjust a wastegate positioned in a bypass around the turbine to maintain the desired turbine speed at 308. More specifically, the controller may open or increase an opening of the wastegate to reduce turbine speed to the desired turbine speed.

The method continues to 309 to determine if the pressure difference between the exhaust pressures of the donor and non-donor cylinders (e.g., the pressure difference determined at 302) is greater than a second threshold difference, the second threshold greater than the first threshold at 304. If the pressure difference is greater than the second threshold pressure difference, the method continues to 310 to shut down the engine. In alternate embodiments, the engine may shut down responsive to the pressure difference increasing above the first threshold difference at 304. As such, the methods at 308 and 310 may occur simultaneously. The method continues to 311 to direct troubleshooting around the second EGR valve and/or EGR cooler. For example, the method may include initiating a diagnostic routine to verify degradation of the second EGR valve and/or fouling of the EGR cooler. In another example, the method may include actuating the second EGR valve to attempt to un-stick or correctly position the valve (e.g., open the valve if it is stuck or inappropriately closed).

Alternately at 309, if the pressure difference is not greater than the second threshold difference, the method continues to 320 to continue engine operation and not shut down the engine.

Returning to 306, if the donor exhaust manifold pressure is not driving the pressure difference between the donor and non-donor manifold exhaust pressures, the method continues on to 314 to determine if the exhaust pressure from the non-donor exhaust manifold is driving the pressure difference. In other words, the method at 314 may include determining if the exhaust pressure from the non-donor exhaust manifold is changing more than the exhaust pressure from the donor exhaust manifold. For example, the method at 314 may determine if the non-donor manifold exhaust pressure is increasing while the donor manifold exhaust pressure is within a threshold of an average (or previous) value. In one example, the method at 314 may include determining if the non-donor exhaust manifold pressure is decreasing (e.g., from a base, average, or previous level) by a threshold amount while the pressure difference between the two exhaust pressures is greater than the threshold difference. In this way, the difference between the donor and non-donor exhaust pressures may be increasing due to the non-donor exhaust manifold pressure decreasing.

If the exhaust pressure from the non-donor exhaust manifold is not driving the pressure difference (e.g., the exhaust pressure from the non-donor exhaust manifold is not decreasing by the threshold amount), the method may include waiting until the threshold change is detected at 315. As such, the method may return to 306.

Conversely, if the exhaust pressure from the non-donor exhaust manifold is driving the pressure difference and/or decreasing by the threshold amount, the method continues on to 316 to indicate degradation of the first EGR valve controlling exhaust flow from the donor cylinders to the exhaust passage, downstream from the non-donor cylinder exhaust manifold. For example, if the first EGR valve is stuck closed (e.g., either due to degradation, mispositioning, mechanical failure, and/or valve driving actuator failure), all the exhaust flow from the donor cylinders may be directed through the EGR system to the intake passage. Thus, exhaust flow that was flowing to the exhaust passage (or was commanded to flow to the exhaust passage) from the donor cylinders may not enter the exhaust passage. As a result in the decrease in exhaust flow to the exhaust passage from the donor cylinders, the exhaust pressure in the exhaust passage downstream from the non-donor cylinders (and/or in the non-donor exhaust manifold) may decrease. The decrease in exhaust flow through the exhaust passage may also result in a decrease in turbine speed of the turbine of the one or more turbochargers. Thus, a decrease in turbine speed while the exhaust pressure difference between the donor and non-donor exhaust manifolds is greater than the threshold difference may confirm degradation of the first EGR valve. In one example, the decrease in turbine speed may be a sudden decrease in turbine speed, the sudden decrease in turbine speed being a threshold decrease in turbine speed over a threshold duration. For example, the turbine speed decreasing by the threshold amount within the threshold duration (e.g., within a finite duration) may confirm the first EGR valve is degraded. The exhaust pressure from the donor exhaust manifold may remain the same and/or only change slightly in comparison to the decrease in the non-donor manifold exhaust pressure. Thus, the pressure difference between these two exhaust pressures increases due to an unintentionally closed first EGR valve.

Additionally, the method at 316 may include adjusting fueling to the engine cylinders (e.g., non-donor and/or donor cylinders) based on the decrease in turbine speed resulting from the decrease in exhaust pressure from the non-donor exhaust manifold. The decrease in turbine speed results in a decrease in boost provided to the engine via a compressor coupled to the turbine. Thus, the controller may increase the fuel delivered to the engine cylinders to compensate for the reduction in boost. The controller may increase fueling until fueling reaches an upper fueling threshold where fueling may not be further increased. In response to reaching this threshold, the controller may de-rate the engine (e.g., decrease a notch setting and/or decrease engine speed). The engine de-rating may occur until the engine is shut down, as described below at 318.

The method then continues to 317 to determine if the pressure difference between the exhaust pressures of the donor and non-donor cylinders (e.g., the pressure difference determined at 302) is greater than a second threshold difference, the second threshold greater than the first threshold at 304. If the pressure difference is greater than the second threshold pressure difference, the method continues to 318 to shut down the engine. In alternate embodiments, the engine may shut down responsive to the pressure difference increasing above the first threshold difference at 304. As such, the methods at 316 and 318 may occur simultaneously. The method then continues to 322 to direct troubleshooting around the first EGR valve. For example, the method may include initiating a diagnostic routine to verify degradation of the first EGR valve and not the second EGR valve, EGR cooler, or another system component. In another example, the method may include actuating the first EGR valve to attempt to un-stick or correctly position the valve (e.g., open the valve if it is stuck or inappropriately closed).

Alternately at 317, if the pressure difference is not greater than the second threshold difference, the method continues to 319 to continue engine operation and not shut down the engine.

The methods at 311 and 322 may additionally include shutting off fueling to the non-donor engine cylinders if the engine has not been shut down. In this way, if one or more components of the EGR system are degraded, the controller may effectively shut of exhaust flow through the EGR system.

In another embodiment, method 300 may be used to diagnose a condition of backpressured valves on two separate engine cylinder banks. For example, an engine may have two cylinder banks. Method 300 may then determine the pressure difference between exhaust pressures of each of the two cylinder banks. This information may then be used, as described above, to determine which of the valves downstream from the two cylinder banks are degraded.

FIG. 4 shows a graph 400 illustrating changes in exhaust pressures due to a condition of a first EGR valve. As described above, the first EGR valve is a valve positioned in an EGR system downstream of one or more donor cylinders, the first EGR valve controlling flow of exhaust from the one or more donor cylinders to the exhaust passage downstream of a non-donor cylinder exhaust manifold. Further, the condition of the first EGR valve may be a closed valve when it is commanded open. For example, the first EGR valve may become stuck in the closed position and/or become degraded such that it remains in the closed position. In yet another example, the actuator of the first EGR valve may malfunction, thereby inappropriately positioning the first EGR in the closed position. Graph 400 shows changes in a first exhaust pressure of a group of donor cylinders at plot 402, changes in a second exhaust pressure of a group of non-donor cylinders at plot 404, changes in turbine speed at plot 405, changes in engine fueling at plot 406, changes in engine operation at plot 408, and an indication of degradation (or mispositioning) of the first EGR valve at plot 410.

Prior to time t1, the engine is operating (plot 408) and a pressure difference between the first exhaust pressure and second exhaust pressure is less than a threshold pressure difference. For example, the pressure difference between the first and second exhaust pressures may be within a range of an average pressure difference during non-degraded engine operation, as indicated at 412. At time t1, the second exhaust pressure of the non-donor cylinders begins decreasing (plot 404). However, at time t1, the first EGR valve may be commanded at least partially open. Since the first EGR valve may be closed when it is supposed to be at least partially open, exhaust flow from the donor cylinders to the exhaust passage decreases. As a result, the turbine speed of a turbine downstream of where exhaust flow from the first EGR valve enters the exhaust passage decreases (plot 405). In response to decreasing turbine speed, the engine controller increases fueling to the engine cylinders (plot 406) in order to compensate for the loss in boost pressure.

At time t2, the pressure difference between the first exhaust pressure and the second exhaust pressure increases to (or above) a threshold pressure difference, as indicated at 414. In response to the pressure difference reaching the threshold pressure difference, the controller may indicate degradation of the first EGR valve (plot 410). In one embodiment, this may include indicating the first EGR valve is suspected to be stuck or mispositioned. At time t3, the pressure difference increases to a second threshold difference, as indicated at 416, the second threshold difference greater than the first threshold difference. In response to the pressure difference reaching the second threshold difference, the controller may shut down the engine (plot 408). Additionally at time t3, engine fueling may reach an upper fueling threshold 418. In some embodiments, if engine fueling reaches the upper fueling threshold before the engine shuts down (e.g., before the pressure difference reaches the second threshold difference), the controller may de-rate the engine. In an alternate embodiment, the controller may shut down the engine at time t2 when the pressure difference reaches the first threshold difference. After indicating degradation of the first EGR valve, a valve diagnostic may be run in order to un-stick and/or further confirm diagnosis of the first EGR valve. Following appropriate diagnosis and servicing, the engine may be re-started.

Turning now to FIG. 5, a graph 500 illustrates changes in exhaust pressures due to a condition of a second EGR valve and/or an EGR cooler. As described above, the second EGR valve is positioned in the EGR system downstream of one or more donor cylinders, the second EGR valve controlling flow of exhaust from the one or more donor cylinders to the intake passage. The EGR cooler may be downstream of the second EGR valve in the EGR system. Further, the condition of the second EGR valve may be a closed valve when it is commanded open. For example, the second EGR valve may become stuck in the closed position and/or become degraded such that it remains in the closed position (even when it is commanded open). In yet another example, the actuator of the second EGR valve may malfunction, thereby inappropriately positioning the second EGR in the closed position. Graph 500 shows changes in a first exhaust pressure of a group of donor cylinders at plot 502, changes in a second exhaust pressure of a group of non-donor cylinders at plot 504, changes in turbine speed at plot 505, changes in engine fueling at plot 506, changes in engine operation at plot 508, and an indication of degradation (or mispositioning) of the second EGR valve and/or EGR cooler at plot 510.

Prior to time t1, the engine is operating (plot 508) and a pressure difference between the first exhaust pressure and second exhaust pressure is less than a threshold pressure difference. For example, the pressure difference between the first and second exhaust pressures may be within a range of an average pressure difference during non-degraded engine operation, as indicated at 512. At time t1, the first exhaust pressure of the donor cylinders begins increasing (plot 504). However, at time t1, the second EGR valve may be commanded at least partially open. Since the second EGR valve may be closed when it is supposed to be at least partially open, exhaust flow from the donor cylinders to the intake passage decreases. If the first EGR valve is at least partially open, as shown in FIG. 5, exhaust flow may increase to the exhaust passage, thereby increasing turbine speed of the turbine (plot 505). In response to increasing turbine speed, the engine controller decreases fueling (plot 506). In an alternate embodiment, the second EGR valve may be open, but the EGR cooler may be fouled (e.g., clogged), thereby increasing flow resistance through the EGR cooler and decreasing exhaust flow to the intake passage from the donor cylinders. In this way, a closed second EGR valve and clogged EGR cooler may both increase flow resistance through the EGR passage to the intake passage, thereby resulting in an increase in exhaust pressure of the donor cylinders.

At time t2, the pressure difference between the first exhaust pressure and the second exhaust pressure increases to (or above) a threshold pressure difference, as indicated at 514. In response to the pressure difference reaching the threshold pressure difference, the controller may indicate degradation of the second EGR valve and/or the EGR cooler (plot 510). In one embodiment, this may include indicating the second EGR valve is suspected to be stuck or mispositioned. In another embodiment, this may include indicating potential fouling of the EGR cooler. At time t3, the pressure difference increases to a second threshold difference, as indicated at 516, the second threshold difference greater than the first threshold difference. In response to the pressure difference reaching the second threshold difference, the controller may shut down the engine (plot 508). In an alternate embodiment, the controller may shut down the engine at time t2 when the pressure difference reaches the first threshold difference. After indicating degradation of the second EGR valve and/or the EGR cooler, a valve diagnostic may be run in order to un-stick and/or further confirm diagnosis of the second EGR valve. Following appropriate diagnosis and servicing, the engine may be re-started.

As described herein, engine shutdown may occur when a pressure difference between exhaust pressures of a donor cylinder exhaust manifold and a non-donor cylinder exhaust manifold increases above a first or second threshold pressure difference. A technical effect is achieved by determining which of these two pressures is driving the increase in the pressure difference and thereby determining which engine system component is majorly contributing to the increase in pressure difference. For example, if the increase in pressure difference is due to a decrease in exhaust pressure from the non-donor exhaust manifold, the first EGR valve directing exhaust from the donor cylinders to the exhaust passage may be degraded. As described herein, a degraded valve may include a stuck valve, mispositioned valve, mechanically degraded valve, and/or a degraded valve actuator. Alternatively, if the increase in pressure difference is due to an increase in exhaust pressure from the donor exhaust manifold, the second EGR valve may be degraded and/or the EGR cooler may be fouled (e.g., plugged such that the flow resistance has increased substantially). Thus, by narrowing in on which EGR system component(s) may have caused the increase in the pressure difference and engine shutdown (or unstable engine operation), the identified component may be serviced more quickly, thereby decreasing the time the engine is shutdown or not operating properly. Further, this diagnostic may help to correctly diagnose the problem resulting in engine shutdown, thereby decreasing a likelihood of subsequent engine shutdowns.

As one embodiment, a method for an engine comprises selectively routing exhaust from a first subset of engine cylinders to an exhaust passage via a first valve and to an intake passage via a second valve and determining a respective condition of each of the first valve and second valve based on a first exhaust pressure of the first subset of engine cylinders and a second exhaust pressure of a second subset of engine cylinders. In one example, determining the respective condition of each of the first valve and second valve is further based on a change of one of the first exhaust pressure or the second exhaust pressure. In another example, determining the respective condition of each of the first valve and second valve is further based on a difference between the first exhaust pressure and the second exhaust pressure and a change in one or more of the first exhaust pressure or the second exhaust pressure. In yet another example, determining the respective condition of each of the first valve and second valve includes indicating valve degradation based on the difference between the first exhaust pressure and the second exhaust pressure increasing above a threshold difference, the threshold difference based on a pressure difference during non-degraded valve operation.

As one example, determining the respective condition of each of the first valve and second valve includes indicating the first valve is degraded responsive to the second exhaust pressure decreasing by a threshold amount, the threshold amount greater than the change in the first exhaust pressure. Additionally, the method includes confirming degradation of the first valve based on a sudden decrease in turbine speed of a turbocharger positioned in the exhaust passage during the increase in the difference between the first exhaust pressure and the second exhaust pressure. The method may further include increasing fueling to the first subset and the second subset of engine cylinders in response to the sudden decrease in turbine speed.

As another example, determining the respective condition of each of the first valve and second valve includes indicating the second valve is degraded responsive to the first exhaust pressure increasing by a threshold amount, the threshold amount greater than the change in the second exhaust pressure. The method further includes initiating a diagnostic routine to verify degradation of the second valve in response to indicating degradation of the second valve. Additionally, the first exhaust pressure is measured by a first pressure sensor positioned in a donor exhaust manifold coupled to the first subset of engine cylinders and the second exhaust pressure is measured by a second pressure sensor positioned in the exhaust passage upstream of a turbocharger and downstream from the second subset of engine cylinders. Further, the second subset of engine cylinders routes exhaust exclusively to the exhaust passage and the first subset of engine cylinders includes a plurality of donor cylinders. Further still, the first valve and the second valve are part of an exhaust gas recirculation system.

As another embodiment, a system comprises an engine having a first subset of cylinders coupled to an exhaust gas recirculation (EGR) system and a second subset of cylinders coupled to an exhaust passage of the engine; a first valve adapted to route exhaust from the first subset of cylinders to the exhaust passage; a second valve adapted to route exhaust from the first subset of cylinders to an intake passage of the engine; and a controller configured to selectively route exhaust from the first subset of engine cylinders to the exhaust passage via the first valve and to an intake passage via the second valve; and determine a respective condition of each of the first valve and second valve based on a first exhaust pressure of the first subset of engine cylinders and a second exhaust pressure of a second subset of engine cylinders.

As still another embodiment, a method comprises selectively routing exhaust from a first subset of engine cylinders of an engine to an exhaust passage via a first valve and to an intake passage via a second valve while routing exhaust from a second subset of engine cylinders to the exhaust passage. The method further comprises indicating degradation of the first valve based on a first exhaust pressure of the first subset of engine cylinders and a second exhaust pressure of the second subset of engine cylinders when the second exhaust pressure is changing more than the first exhaust pressure and indicating degradation of the second valve based on the first exhaust pressure and the second exhaust pressure when the first exhaust pressure is changing more than the second exhaust pressure.

In one example, indicating degradation of the first valve includes indicating degradation when a difference between the first exhaust pressure and the second exhaust pressure is greater than a first threshold difference and the second exhaust pressure is decreasing while the first exhaust pressure is maintained within a threshold of an average value. In another example, indicating degradation of the second valve includes indicating degradation when the difference between the first exhaust pressure and the second exhaust pressure is greater than the first threshold difference and the first exhaust pressure is increasing while the second exhaust pressure is maintained within a threshold of the average value.

The method further comprises indicating degradation of an EGR cooler positioned downstream of the second valve responsive to the difference between the first exhaust pressure and the second exhaust pressure increasing above the first threshold difference due to the first exhaust pressure increasing. The method may further comprise shutting down the engine in response to the difference between the first exhaust pressure and the second exhaust pressure being greater than the first threshold difference. In another example, the method may further comprise shutting down the engine in response to the difference between the first exhaust pressure and the second exhaust pressure being greater than a second threshold difference, the second threshold difference greater than the first threshold difference. Additionally, indicating degradation of the first valve or the second valve may include alerting a vehicle operator that one of the first valve or the second valve is degraded. The method may further comprise actuating the indicated valve to attempt to un-stick the indicated valve.

As another embodiment, a system comprises an engine having a first subset of cylinders coupled to an exhaust gas recirculation (EGR) system and a second subset of cylinders coupled to an exhaust passage of the engine; a first valve adapted to route exhaust from the first subset of cylinders to the exhaust passage; a second valve adapted to route exhaust from the first subset of cylinders to an intake passage of the engine; and a controller configured to selectively route exhaust from the first subset of engine cylinders of the engine to the exhaust passage via the first valve and to the intake passage via the second valve while routing exhaust from the second subset of engine cylinders to the exhaust passage. The controller is further configured to indicate degradation of the first valve based on a first exhaust pressure of the first subset of engine cylinders and a second exhaust pressure of the second subset of engine cylinders when the second exhaust pressure is changing more than the first exhaust pressure; and indicate degradation of the second valve based on the first exhaust pressure and the second exhaust pressure when the first exhaust pressure is changing more than the second exhaust pressure.

As yet another embodiment, a system comprises an engine having a first subset of cylinders coupled to an exhaust gas recirculation (EGR) system and a second subset of cylinders coupled to an exhaust passage of the engine; a first valve adapted to route exhaust from the first subset of cylinders to the exhaust passage; and a second valve adapted to route exhaust from the first subset of cylinders to an intake passage of the engine. The system further comprises a controller configured to indicate a condition of the exhaust gas recirculation system based on a pressure difference between a first exhaust pressure of the first subset of cylinders and a second exhaust pressure of the second subset of cylinders increasing by a threshold amount and differentiate between degradation of the first valve and the second valve based on which of the first exhaust pressure or second exhaust pressure changes to a greater extent.

The controller is further configured to indicate degradation of the first valve when the second exhaust pressure changes more than the first exhaust pressure, the first exhaust pressure measured by a first pressure sensor positioned in an exhaust manifold of the first subset of cylinders upstream of the first valve and second valve. The second exhaust pressure is measured by a second pressure sensor positioned in the exhaust passage upstream from a turbocharger.

The system further comprises an EGR cooler positioned in the EGR system downstream from the second valve. The controller is further configured to indicate degradation of one of the second valve or the EGR cooler when the first exhaust pressure changes more than the second pressure exhaust pressure.

As used herein, an element or step recited in the singular and proceeded with the word "a" or "an" should be understood as not excluding plural of said elements or steps, unless such exclusion is explicitly stated. Furthermore, references to "one embodiment" of the invention do not exclude the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A method for an engine, comprising:

selectively routing exhaust from a first subset of engine cylinders to an exhaust passage via a first valve and to an intake passage via a second valve;

determining a respective condition of each of the first valve and second valve based on a first exhaust pressure of the first subset of engine cylinders and a second exhaust pressure of a second subset of engine cylinders, a difference between the first exhaust pressure and the second exhaust pressure, and a change in one or more of the first exhaust pressure or the second exhaust pressure; and indicating valve degradation based on the difference between the first exhaust pressure and the second exhaust pressure increasing above a threshold difference, the threshold difference based on a pressure difference during non-degraded valve operation.

2. The method of claim 1, wherein determining the respective condition of each of the first valve and second valve includes indicating valve degradation based on the difference between the first exhaust pressure and the second exhaust pressure increasing above the threshold difference, the threshold difference based on the pressure difference during non-degraded valve operation.

3. The method of claim 1, wherein determining the respective condition of each of the first valve and second valve includes indicating the first valve is degraded responsive to the second exhaust pressure decreasing by a threshold amount, the threshold amount greater than the change in the first exhaust pressure.

4. The method of claim 3, further comprising confirming degradation of the first valve based on a sudden decrease in turbine speed of a turbocharger positioned in the exhaust passage during the increase in the difference between the first exhaust pressure and the second exhaust pressure.

5. The method of claim 4, further comprising increasing fueling to the first subset and the second subset of engine cylinders in response to the sudden decrease in turbine speed.

6. The method of claim 1, wherein determining the respective condition of each of the first valve and second valve includes indicating the second valve is degraded responsive to the first exhaust pressure increasing by a threshold amount, the threshold amount greater than the change in the second exhaust pressure.

7. The method of claim 6, further comprising initiating a diagnostic routine to verify degradation of the second valve in response to indicating degradation of the second valve.

8. The method of claim 1, wherein the first exhaust pressure is measured by a first pressure sensor positioned in a donor exhaust manifold coupled to the first subset of engine cylinders, wherein the second exhaust pressure is measured by a second pressure sensor positioned in the exhaust passage upstream of a turbocharger and downstream from the second subset of engine cylinders, the second subset of engine cylinders routing exhaust exclusively to the exhaust passage, and wherein the first subset of engine cylinders includes a plurality of donor cylinders and the first valve and the second valve are part of an exhaust gas recirculation system.

9. A method, comprising:

selectively routing exhaust from a first subset of engine cylinders of an engine to an exhaust passage via a first valve and to an intake passage via a second valve while routing exhaust from a second subset of engine cylinders to the exhaust passage;

indicating degradation of the first valve based on a first exhaust pressure of the first subset of engine cylinders and a second exhaust pressure of the second subset of engine cylinders when the second exhaust pressure is changing more than the first exhaust pressure; and indicating degradation of the second valve based on the first exhaust pressure and the second exhaust pressure when the first exhaust pressure is changing more than the second exhaust pressure, wherein indicating degradation of the first valve includes indicating degradation when a difference between the first exhaust pressure and the second exhaust pressure is greater than a first threshold difference and the second exhaust pressure is decreasing while the first exhaust pressure is maintained within a threshold of an average value.

10. The method of claim 9, wherein indicating degradation of the second valve includes indicating degradation when the difference between the first exhaust pressure and the second exhaust pressure is greater than the first threshold difference and the first exhaust pressure is increasing while the second exhaust pressure is maintained within a threshold of the average value.

11. The method of claim 9, further comprising indicating degradation of an EGR cooler positioned downstream of the second valve responsive to the difference between the first exhaust pressure and the second exhaust pressure increasing above the first threshold difference due to the first exhaust pressure increasing.

12. The method of claim 9, further comprising shutting down the engine in response to the difference between the first exhaust pressure and the second exhaust pressure being greater than the first threshold difference.

13. The method of claim 9, further comprising shutting down the engine in response to the difference between the first exhaust pressure and the second exhaust pressure being greater than a second threshold difference, the second threshold difference greater than the first threshold difference.

14. A method, comprising:

selectively routing exhaust from a first subset of engine cylinders of an engine to an exhaust passage via a first valve and to an intake passage via a second valve while routing exhaust from a second subset of engine cylinders to the exhaust passage;

indicating degradation of the first valve based on a first exhaust pressure of the first subset of engine cylinders and a second exhaust pressure of the second subset of engine cylinders when the second exhaust pressure is changing more than the first exhaust pressure; and indicating degradation of the second valve based on the first exhaust pressure and the second exhaust pressure when the first exhaust pressure is changing more than the second exhaust pressure, wherein indicating degradation of the first valve or the second valve includes alerting a vehicle operator that the first valve or the second valve is degraded and further comprising actuating the first valve or the second valve to attempt to un-stick the first valve or the second valve.

* * * * *